United States Patent [19]

Pitts

[11] 4,023,814

[45] May 17, 1977

[54] TREE SAVER PACKER CUP

[75] Inventor: Charles A. Pitts, Wichita Falls, Tex.

[73] Assignee: The Dow Chemical Company, Midland, Mich.

[22] Filed: July 16, 1975

[21] Appl. No.: 596,497

[52] U.S. Cl. ..... 277/181; 166/75 R; 166/202

[51] Int. Cl.[2] ..... F16J 15/32

[58] Field of Search ..... 166/75, 84, 202, 179; 277/181, 206

[56] References Cited

UNITED STATES PATENTS

| | | | |
|---|---|---|---|
| 2,927,643 | 3/1960 | Dellinger | 166/75 |
| 3,053,321 | 9/1962 | Ortloff | 166/202 |

*Primary Examiner*—Robert I. Smith

*Attorney, Agent, or Firm*—M. B. Lilly; Earl D. Ayers

[57] ABSTRACT

The invention is a packer cup assembly which attaches to the lower end of the mandrel in the tree saver which is itself attached to the "Christmas Tree" of a well head or the like. The assembly is tubular in configuration and comprises a metal part with internal threads at one end and a thinner walled part at its other end. The outer diameter of the lower end of the metal part is less than the outer diameter of the threaded end part in order to permit an elastomeric sleeve to fit over and extend beyond the reduced diameter end part of the metal part. The outer end of the elastomeric sleeve is flared outwardly and then tapered inwardly to facilitate entry into a string of tubing or the like. The other end of the elastomeric sleeve is bonded to the outer surface of the metal part.

1 Claim, 2 Drawing Figures

TREE SAVER PACKER CUP

BACKGROUND OF THE INVENTION

This invention relates to so-called tree savers and particularly to a packer cup assembly for use with tree savers.

Many oil and gas wells or the like have a so- called Christmas Tree assembly which includes various valves and special coupling means, for example, and which extends vertically from the well head. The Christmas Tree is coupled at its lower end to the well casing and (at least usually) to a string of tubing within the casing.

Many Christmas Trees are unable to withstand the high pressures used in present day well stimulation treatments. Other Christmas Trees, though able to withstand the pressures involved in the well stimulation treatment, might be physically harmed by the material being pumped into the well during its treatment.

Tree savers, conventionally coupled to the upper end of the Christmas Tree, have an internal movable mandrel which then is forced down through the Christmas Tree to seal at its lower end against the upper end of the tubing which is coupled to the lower end of the Tree.

In some tree savers the internal diameter of the movable mandrel must be substantially reduced in order for the lower end of the mandrel to accommodate a sealing assembly which seals against the upper end of the tubing string.

In another tree saver, the packer device at the lower end of the mandrel has a configuration such that it cannot seal against or enter any device in the Christmas Tree which is of smaller diameter than the internal diameter of the tubing.

OBJECTS OF THE INVENTION

A principal object of this invention is to provide an improved packer cup assembly for use in a tree saver.

Another object of this invention is to provide an improved packer cup assembly for use in a tree saver which permits essential leak free coupling to a string of tubing or the like.

A further object of this invention is to provide an improved packing cup assembly for a tree saver which provides good flow characteristics through the mandrel of the tree saver.

STATEMENT OF INVENTION

In accordance with this invention there is provided a tube-like assembly having at one end a metal part including means for attaching it to the lower end of a mandrel of a tree saver tool and another end part of reduced outer diamter. The end part of reduced diameter has a tubular elastomeric part bonded to it over a major part of its length. The elastomer part extends beyond the end of the metal part and flares gradually outwardly to slightly more than the inner diameter of the tubing the assembly is to enter, then tapers inwardly at the end which extends beyond the metal part.

The inner wall of the metal part tapers outwardly from near the unattached end, and the elastomeric part continues this taper.

BRIEF DESCRIPTION OF THE DRAWING

The invention, as well as additional objects and advantages thereof, will best be understood when the following detailed description is read in connection with the accompanying drawings, in which.

DETAILED DESCRIPTION OF THE DRAWING

Figure 1:
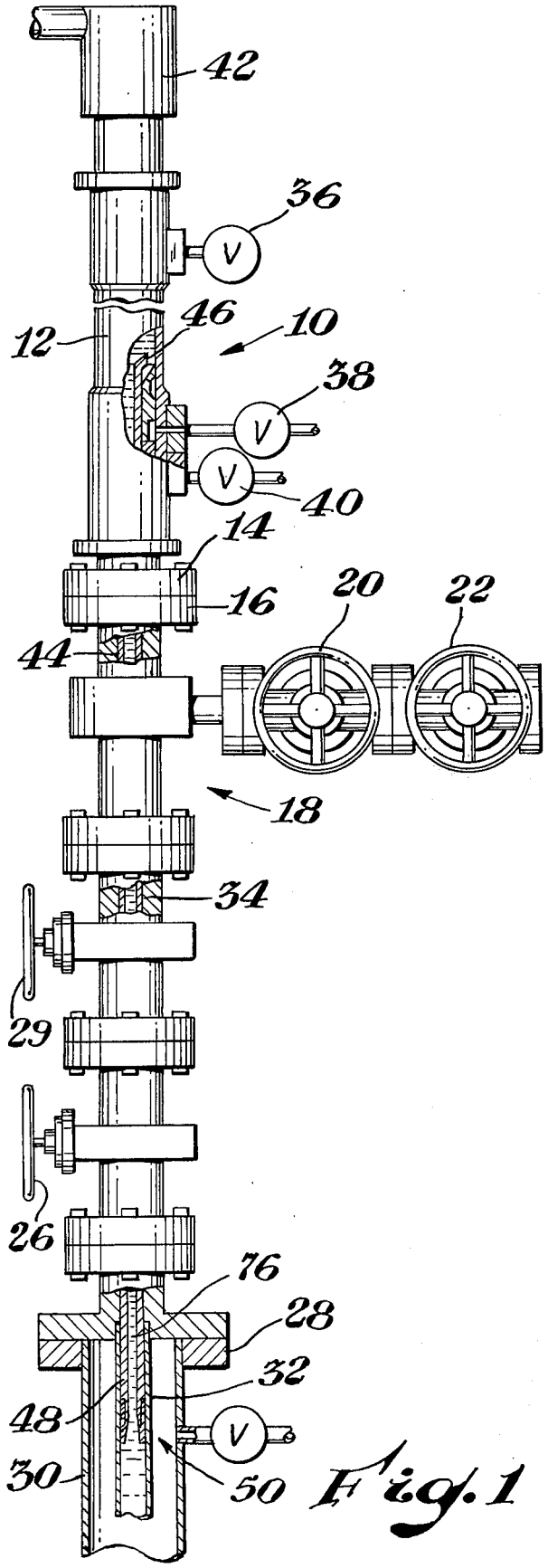
FIG. 1 is a side elevational view, partly broken away and in section, of a tree saver incorporating this invention and coupled to a string of tubing through a Christmas tree.

Referring to the drawing, and particularly to FIG. 1, there is shown a tree saver, indicated generally by the numeral 10, comprising an elongated barrel 12 attached at its lower flanged end 14 to the upper flanged part 16 of a Christmas tree assembly, indicated generally by the numeral 18.

The Christmas tree 18 is attached at its lower end by a coupler 28 to the casing 30 of an earth well. The lower end of the Christmas tree 18 is also coupled to a string of tubing 32 which fits within the casing 30.

The Christmas tree includes valves 24, 26 along its length for opening and closing the vertical passaage through the "tree" and valves 20, 22, connected laterally along the tree above valves 24, 26.

The tree saver 12 includes side valves 36, 38, 40 along its barrel, a top connector 42 for coupling to a pressurizable fluid source, and a longitudinally movable mandrel 44 which lies retracted within the tree saver except during a well treatment, as is well-known in the art.

The lower end 48 of the mandrel 44 has a packer cup assembly, indicated generally by the numeral 50, attached to it. The end 48 and packer cup 50 fit within and seals with respect to the upper end part of the tubing 32 when the mandrel 44 is lowered prior to the beginning of the pumping of fluid into the well through the tree saver 10.

Figure 2:
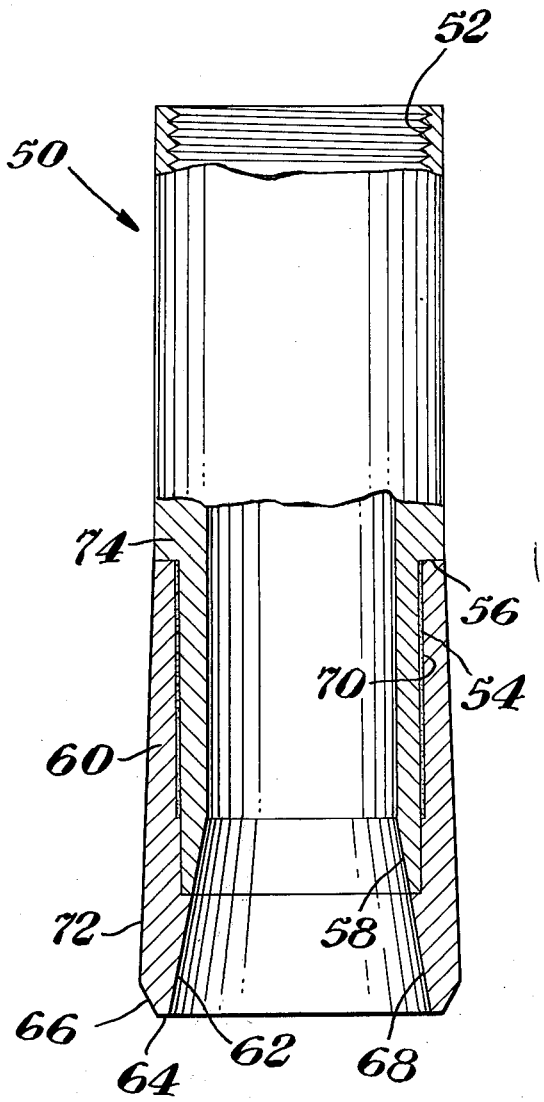
FIG. 2 is a sectional view of the packing cup assembly of this invention.

Referring to FIG. 2, the packer cup assembly 50 includes a generally tubular metal member 74 having internally threaded attaching means 52 at one end, an elongated part 54 at the other end which is of lesser outer diameter than the remainder of the member 74.

A tubular elastomeric sleeve-like element 60 fits over the reduced outer diameter part of the member 74, abutting against the shoulder 56 thereof.

The sleeve element 60 is bonded by bonding material 70 to the member 74 from the shoulder 56 to the point along its length at which the inner diameter has an outwardly tapered part 56 which extends to the end of the member 70 which is opposite the attaching means 52.

The sleeve element 60 extends beyond the tapered end part 58, the inner surface 68 of the extended part 64 being tapered to conform to the taper angle of the part 58.

The outer peripheral surface of the end part 64 tapers outwardly slightly so that the outer diameter slightly exceeds the outer diameter of the member 74.

The end 64 of the elastomeric sleeve element 60 has its outer surface 66 tapered inwardly at about a 30° angle.

The elastomeric sleeve element 60 is made of an oil and gas resistant rubber-like material with the bonding material being any known strong bonding agent used to bond rubber-like material to metal.

The steel used in making the tubular member 74 may be any alloy heat treated steel with at least 110,000 pounds minimum yield strength.

The outer diameter of the attaching end one packer cup assembly 50 is 1.9 inches, while the maximum diameter of the slightly outwardly flared elastomeric part is 2.025 inches. The overall length of this assembly is 6 inches and the minimum inner diameter of the assembly is 1.25 inches. The length of the elastomeric sleeve is approximately 3 inches. The outwardly tapered end part of the member 74 is about ½ inch in length with the taper angle being approximately 10°.

OPERATION

In operation, the tree saver 10, with the mandrel 44 withdrawn upwardly, is coupled and sealed to the upper end of the Christmas tree 18. By applying pressure through valve 36, for example, the mandrel 44, capable of withstanding the pressure involved in the well treatment and being resistant to attack by the well treating material, is forced downwardly through the Christmas tree (the valves 24, 26 being opened) until the lower end 48 of the mandrel which has the packer cup assembly 50 attached thereto, enters into the upper end of the tubing 32.

The tapered surface 66 tends to center the packer cup assembly on the upper end of the tubing 32, with the elastomeric part 60 compressing as the mandrel 44 is lowered into the tubing.

Once the lower part of the mandrel 44 is in place in the tubing 32, pressure applied as treating agent 76 is pumped down the mandrel 44 forcing the lower end part of the elastomeric sleeve element 60 to expand and seal against the inner wall of the tubing 32. The approximately half inch (tapered part) at the lower end of the tubular member 74 which is not bonded to the sleeve element 60 permits easier flexing of the element 60 to facilitate flexing along a substantial part of the element 60 to effect a seal with respect to the tubing.

The tapering of the lower end of the member 74 also permits some degree of flexing, if needed, as the cup assembly 50 enters the tubing.

The cup assembly of this invention has been shown to seal against uneven wall surfaces of the tubing while permitting an improved flow of treating agent through the mandrel because of its large internal diameter.

With the seal effected, the Christmas tree is effectively isolated from the high pressures and/or attack by the treating agent, since the mandrel 44 can withstand the well treating pressures and all flow to the well is through the mandrel 44.

Other tree savers have a cup sealing assembly which seals against the upper end of the tubing. Irregularities at the upper end of the tubing often make it difficult to achieve a seal where so little surface area is involved.

Further, the outer diameter of the cup assemblies and/or the means of attaching them to the retractable mandrel tend to result in a smaller diameter passage through the mandrel than when the instant assembly is used. Additionally, some prior art cup assemblies will not pass through plug or special choke elements in the Christmas tree and thus cannot reach the tubing to seal against it.

What is claimed is:

1. A tree saver in combination with a Christmas Tree assembly, said tree saver being coupled to the upper end thereof and having an advanceable and retractable mandrel which has a packer assembly adapted to seal said mandrel to a string of tubing which is coupled to the lower end of said Christmas Tree assembly, the improvement wherein said packer cup assembly comprises an elongated metal tubular member having an outer diameter such that it will fit closely but slideably within said tubing, said tubular member having a first open ended part coupled and sealed against said mandrel, a second end part of reduced outer diameter having a flexible open ended section and an outer wall surface, and a yieldable sleeve including an inwardly tapered unattached end, said sleeve fitting closely over and being bonded to the outer wall surface of said second end part of reduced outer diameter, said sleeve extending substantially beyond said tubular member in the direction away from said first open ended part and having an outer diameter which fits closely but slidably in sealing contact within said string of tubing when said mandrel is advanced therein, the part of said sleeve beyond said tubular member and the open lower end of said second part of reduced outer diameter having an outwardly extending gradually tapered inner wall surface which is of maximum diameter at the end extending beyond said tubular member.

* * * * *

UNITED STATES PATENT AND TRADEMARK OFFICE

CERTIFICATE OF CORRECTION

PATENT NO. : 4,023,814
DATED : May 17, 1977
INVENTOR(S) : Charles A. Pitts

It is certified that error appears in the above-identified patent and that said Letters Patent are hereby corrected as shown below:

In column 1, line 55, delete "diamter" and insert --diameter--.

In column 1, line 57, delete "elastomer" and insert --elastomeric--.

In column 2, line 24, delete "passaage" and insert --passage--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*